US006027402A

United States Patent [19]

Oliver

[11] Patent Number: 6,027,402

[45] **Date of Patent: *Feb. 22, 2000**

[54] COSMETIC FILE/BUFFER WITH MICROENCAPSULATED TREATMENT SUBSTANCES

[75] Inventor: G. Brian Oliver, Newport Coast, Calif.

[73] Assignee: SunFiles, LLC, Del Mar, Calif.

[ * ] Notice: This patent is subject to a terminal disclaimer.

[21] Appl. No.: 09/023,253

[22] Filed: Feb. 13, 1998

Related U.S. Application Data

[63] Continuation-in-part of application No. 08/746,796, Nov. 18, 1996, Pat. No. 5,779,519.

[51] Int. Cl.[7] ..... A45D 29/18; B24D 11/00

[52] U.S. Cl. ..... 451/533; 132/76.4

[58] Field of Search ..... 451/533; 132/76.4, 132/76.5

[56] References Cited

U.S. PATENT DOCUMENTS

| | | | |
|---|---|---|---|
| 2,699,791 | 1/1955 | Hansen | 132/76.4 |
| 3,472,675 | 10/1969 | Gordon et al. | 117/36.9 |
| 4,572,222 | 2/1986 | Pangburn | 132/76.4 |
| 4,687,203 | 8/1987 | Spector | 273/157 |
| 4,764,362 | 8/1988 | Barchas | 424/61 |
| 5,119,839 | 6/1992 | Rudolph | 132/200 |
| 5,779,519 | 7/1998 | Oliver | 451/28 |
| 5,813,416 | 9/1998 | Rudolph | 132/76.4 |

*Primary Examiner*—Joseph J. Hail, III
*Attorney, Agent, or Firm*—Richard L. Myers

[57] ABSTRACT

A fingernail and toenail file/buffer adapted to perform an operative function on a target surface, the file/buffer including a base structure and a substrate layer disposed on the base structure. The file/buffer further comprising an abrasive material, and a multiplicity of microcapsules each enclosing at least one treatment substance. These substances may include, for example, a fragrance, a conditioner, an antibacterial agent, an aroma therapy agent or an appearance enhancer. The microcapsules are adapted to release the enclosed substance when the file/buffer is placed in frictional engagement with the target surface.

18 Claims, 1 Drawing Sheet

FIG. 1
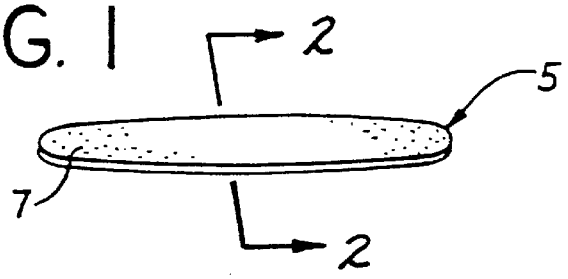
FIG. 3
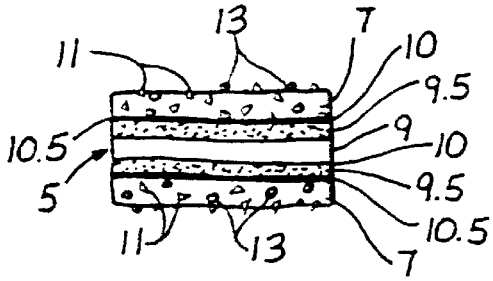
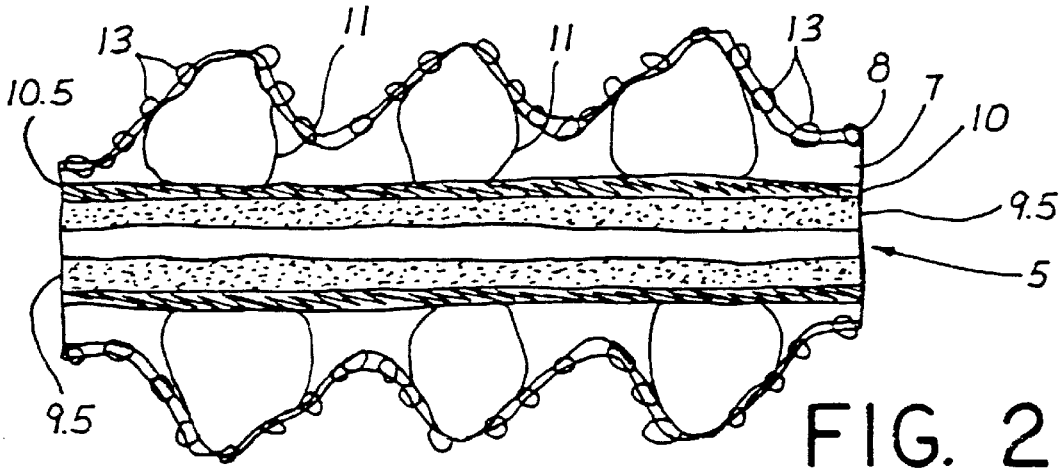
FIG. 2
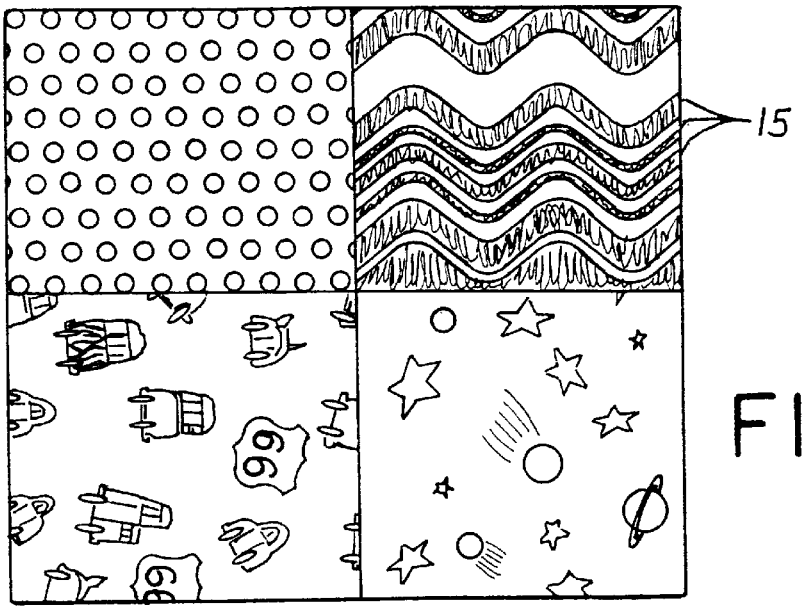
FIG. 4

COSMETIC FILE/BUFFER WITH MICROENCAPSULATED TREATMENT SUBSTANCES

CROSS REFERENCES TO RELATED APPLICATION

This is a Continuation-in-Part of U.S. application Ser. No. 08/746,796, filed on Nov. 18, 1996, and entitled, "Scented Fingernail Files and Buffers," now U.S. Pat. No. 5,779,519.

BACKGROUND OF THE INVENTION

1. Field of the Invention

The present invention relates generally to fingernail and toenail files and buffers (herein collectively referred to as fingernail files), and more specifically, to such files and buffers including treatment substances.

2. Discussion of the Prior Art

Conventional fingernail files and buffers typically comprise a base structure and an abrasive surface disposed thereon. The base structure may comprise a strip of wood, metal or plastic. The abrasive surface usually comprises a fine-grained impure corundum, or silicon carbide, or aluminum oxide, or diamond or glass/quartz, which is suitable for grinding and polishing. A powdered glass, for example, can be applied to the base structure, using an adhesive, to form the abrasive surface.

A fingernail file and buffer can be used to file or polish a fingernail or toenail, as is well known in the art. The fingernail file and buffer is frictionally moved along the surface of the fingernail or toenail in order to shape and smooth or polish the fingernail or toenail, to thereby eliminate splits, snags and chipping, or achieve a high gloss finish. Fingernail files and buffers typically comprise brown, tan, or black abrasive surfaces. These dull colors are not particularly attractive.

Prior art fingernail files and buffers heretofore have never been manufactured with any bright or uplifting colors let alone four-color fashion and graphic designs. Nor have they been made with any fragrances or other treatment substances associated therewith.

Fragrances, which can be activated by frictional contact, have been implemented by the prior art in various devices. U.S. Pat. No. 5,355,551 issued to Schechter et al. discloses a curtain ring having an inner surface coated with a fragrance-emitting material. The fragrance-emitting material can comprise microspheres containing fragrance chemicals, or materials used in "scratch-and-sniff" products. U.S. Pat. No. 3,570,139 issued to Ladd et al., discloses a "scratch-and-sniff" system, which is well known in the art. U.S. Pat. Nos. 4,813,976 and 4,764,362, both issued to Barchas, disclose emery boards having films of lubricant and conditioner disposed thereon. None of the prior art systems, however, have manufactured emery boards having fragrances disposed thereon.

The applicant is not aware of any abrasive structure, having either bright colors and designs or fragrance-filled capsules disposed thereon. Nor is applicant aware of any prior art system having a substrate with both abrasive particles and fragrance-filled capsules formed within the substrate.

SUMMARY OF THE INVENTION

The brightly colored graphics and scented fingernail files and buffers of the present invention are particularly appealing to a user's visual and olfactory senses. Users who do not particularly enjoy filing their nails, for example, may be encouraged to perform this grooming feature more frequently. The fragrances, which are emitted from the scented fingernail file and buffer upon frictional contact with the user's nail, can operate to condition and deodorize the air.

According to one aspect of the present invention, a scented fingernail file and buffer for contacting and filing a target surface includes a base structure and a substrate layer disposed on the base structure. The scented fingernail file and buffer further includes an abrasive material and fragrance capsules. Both the abrasive material and the fragrance-filled capsules are disposed within the substrate layer. This substrate layer may comprise two coats of resin, for example. The abrasive material includes aluminum oxide, or silicon-carbide, or diamond, or glass/quartz particles, and the fragrance-filled capsules are adapted for being ruptured by the abrasive particles, when the scented fingernail file and buffer is frictionally placed into contact with the target surface. The fragrance-filled capsules may also be ruptured by the target surface, or a combination of both the abrasive particles and the target surface, upon such contact.

The scented fingernail file and buffer further includes brightly colored pigments and designs disposed on the surface of the fingernail file and buffer. These pigments and designs may be selected to conjure thoughts of light, bright or fruit shapes and other designs of interest to the user. Additionally, the fragrances emitted by the fragrance-filled capsules can be manufactured to include fruit aromas. The scented fingernail file and buffer may include a nail file, the base structure may include a strip of plastic, and the substrate may include an adhesive, such as a resin. The adhesive operates to attach both the abrasive particles and the fragrance-filled capsules onto the base structure. The substrate layer and the base may be integrally formed of the same materials, according to one aspect of the present invention.

According to a method of the present invention, a scented nail file having a plurality of abrasive particles and fragranced particles disposed therein, is placed into frictional contact with a target surface. The scented nail file is moved over the target surface, which may include the nail of a user, for example. Movement of the scented nail file over the target surface causes the abrasive particles to file the target surface and, simultaneously, causes the fragranced particles to emit fragrances onto the target surface and into the atmosphere.

In addition to the fragrances, it will be apparent that other substances facilitating nail treatment can also be microencapsulated. These substances might include, for example, conditioners, moisturizers, and appearance enhancers. By microencapsulating these active ingredients, oxidation and degradation is greatly reduced since exposure to air only occurs when the microcapsules are ruptured. Furthermore, the amount of active ingredient can be significantly reduced since it is not wasted but rather is applied directly to the target surface or nail.

Providing the microcapsules in various sizes enables them to commingle with the abrasive granules, and also to enhance the uniformity of the microcapsule layer. With these variations in size, the larger microcapsules tend to rupture first; the smaller microcapsules tend to rupture only as the abrasive granules wear down to expose them. It has also been found that the wall thickness associated with the various microcapsules can also be varied. Capsules with thinner walls tend to rupture with less pressure than do the capsules with thicker walls. This structure provides a time-released feature ensuring the availability of the encapsulated substance throughout the life of the implement.

The present invention, together with additional features and advantages thereof, may best be understood by reference to the following description taken in connection with the accompanying illustrative drawings.

DESCRIPTION OF THE DRAWINGS

FIG. 1 illustrates a top planar view of a scented fingernail file and buffer, according to the present invention;

FIG. 2 illustrates a cross-sectional view of the scented fingernail file and buffer, taken along line 2—2 of FIG. 1 according to the presently preferred embodiment;

FIG. 3 illustrates a cross-sectional view of the scented fingernail file and buffer, taken along line 2—2 of FIG. 1 according to an alternative embodiment; and FIG. 4 illustrates a wavy pattern, formed of various color pigments, and formed on a surface of the scented fingernail file and buffer, according to the presently preferred embodiment.

DESCRIPTION OF THE PREFERRED EMBODIMENTS AND BEST MODE OF THE INVENTION

Turning to FIG. 1, a scented fingernail file and buffer 5 is illustrated, according to the presently preferred embodiment. The scented fingernail file and buffer 5 comprises a substrate layer 7 having abrasive particles disposed thereon.

FIG. 2 illustrates a cross-sectional view of the scented fingernail file and buffer 5 of the presently preferred embodiment, taken along line 2—2 of FIG. 1. The scented fingernail file and buffer 5 comprises a base structure 9 and/or 9.5, and at least one substrate layer 7. The base structure 9 may be sandwiched between two layers of foam or similar cushion materials 9.5 and two substrate layers 7, as shown in FIG. 3, for example, or one or more substrate layers 7 may be disposed on only a single side of the base structure 9 and/or 9.5. According to an alternative embodiment, the substrate layer 7 and base structure 9 and/or 9.5 may be integrally formed of the same material.

The embodiment of FIG. 2, which comprises a first substrate layer 7 and a second substrate layer 8, is presently preferred. The first substrate layer 7 comprises abrasive particles 11, and the second substrate layer 8 comprises a fragrance-emitting means 13 disposed therein. The abrasive particles 11 may comprise garnet, flint, and/or abrasive particles, aluminum oxide, silicon carbide, diamond and/or glass/quartz. The fragrance-emitting means 13 may comprise any material that releases fragrance into the surrounding atmosphere when rubbed against an appropriate surface. For example, certain waxes that have been impregnated with fragrance are known to release fragrances into the atmosphere, upon frictional rubbing of the wax. Additionally, materials used in conventional "scratch-and-sniff" products may be used. As presently preferred, the fragrance-emitting means 13 comprises fragrance-filled capsules containing fragrance chemicals. These fragrances may be generated or obtained from a variety of sources. The fragrances are preferably encased in gelatin capsules. The fragrance-filled capsules of the presently preferred embodiment are manufactured by LIPO Technologies Inc., which is headquartered in Peterson, N.J.

In the presently preferred embodiment, both the abrasive particles 11 and the fragrance-filled capsules 13 are suspended within corresponding substrate layers 7 and 8, respectively. As presently embodied, the base 10 may comprise a paper, film, cloth, hydrophilic foam or any combination thereof. The base structure 9 may comprise wood, plastic or metal. A make coat 10.5, which may comprise phenol, urethane, epoxy resin, or any combination thereof, is preferably applied over the base 10. Next, a size coat 10.5, comprising materials similar to the make coat, is applied over the make coat. As can be seen from FIG. 2, the abrasive particles 11 are suspended within the first substrate layer 7. According to the presently preferred embodiment, the size of the abrasive particles is in a range of 30 microns to 70 microns. For slightly finer and rougher surfaces, abrasive particle sizes may be brought down to a 1 (one) micron diameter or up to a 90 micron diameter, respectively. Additionally, other sizes of abrasive particles 11 may be implemented, according to design parameters.

The fragrance-filled capsules 13 may be applied over both the first substrate layer 7 and the abrasive particles 11 in several ways. As presently preferred, the fragrance-filled capsules 13 comprise diameters in a range of 10 to 40 microns, but other sized fragrance-filled capsules 13 may also be used. Regardless of the technique used for applying the fragrance-filled capsules 13, the relatively small sizes of the fragrance-filled capsules 13 will result in the fragrance-filled capsules 13 being disposed over both the abrasive particles 11 and the first substrate layer 7. As can be seen from FIG. 2, for example, a number of the fragrance-filled particles 13 are disposed on top of the abrasive particles 11, and a number of the fragrance-filled capsules are disposed in valleys between the abrasive particles 11, to thereby provide a long-lasting effect. According to this embodiment, as the abrasive particles 11 ware, fragrance-filled capsules 13 in the valleys between the abrasive particles 11 will become active.

In a first application method, the fragrance-filled capsules 13 are mixed in a resin, which forms the second substrate layer 8. The fragrance-filled capsules 13 and the second substrate layer 8 are then applied over the first substrate layer 7 and the abrasive particles 11. The fragrance-filled capsules 13 may, alternatively, be mixed in an aqueous or liquid mineral spirit base and either sprayed or wiped over the first substrate layer 7 and the abrasive particles 11. The aqueous or liquid mineral spirit base then evaporates, exposing the fragrance-filled capsules 13. Other application techniques may also be used, as long as the fragrance-filled capsules 13 are secured to the first substrate layer 7 and the abrasive particles 11.

In one alternative embodiment, the abrasive particles 11 and the fragrance-filled capsules 13 may be mixed together in a resin and then applied to the base 9, as illustrated in FIG. 3. FIG. 3 illustrates an alternative embodiment where the abrasive particles 11 and the fragrance-filled capsules 13 have approximately equal diameters. According to the embodiment illustrated in FIG. 3, abrasive particles 11 and fragrance-filled capsules 13 are disposed on both sides of the base structure 9, but they may alternatively be disposed only on a single side of the base structure 9.

FIG. 4 illustrates the presently preferred pattern of brightly colored pigments 15 that is preferably impregnated into the substrate layers 7, 10 and 10.5. The brightly colored pigments 15 may be applied to the substrate layer 7 at any stage during the manufacturing process. As presently preferred, the brightly colored pigments 15 are applied during the first steps of the manufacture of the scented fingernail file and buffer 5. The brightly colored pigments 15 preferably correspond to colors associated with fruits or plants, for example. In this presently preferred embodiment, the fragrance-filled capsules 13 are configured to emit scents having fruit-like aromas or garden and herbal scents such as roses. The scents may comprise fruit, plant, herbal, other scents occurring in nature and/or man made materials.

A primary function of the fragrance-filled capsules 13 and the brightly colored pigments 15 is to increase the visual and olfactory pleasure of the user, upon use of the scented fingernail file and buffer 5. This augmentation of pleasure, associated with use of the scented fingernail file and buffer 5 of the present invention, can result in increased use of the scented fingernail file and buffer 5 by its users, and can also results in increased sales of the scented fingernail file and buffer 5. Increased use of the scented fingernail file and buffer 5 may be advantageous to users, who do not particularly enjoy filing their fingernails and/or toenails. The association between a colorful fruit design and the corresponding fruit scent which is released while using the fingernail file, enhances the pleasure of the users.

The abrasive particles 11 and the fragrance-filled capsules 13 of the presently preferred embodiment can be configured so that an attenuation in fragrances emitted from the scented fingernail file and buffer 5 upon use will indicate an attenuation in the abrasiveness of the substrate layer 7. A user may desire a consistently abrasive surface in order to predict the amount of filing required on the user's fingernails for consistent results. A user would obviously have to file greater amounts with a slightly abrasive fingernail file and buffer, than with an fingernail file and buffer having an almost-new abrasive surface thereon. A user desiring an fingernail file and buffer with a consistently abrasive surface will, according to this feature of the present invention, know when to replace the scented fingernail file and buffer 5, based upon the strength of the fragrance emitted from the scented fingernail file and buffer 5 during use. For instance, the user may choose to replace the scented fingernail file and buffer 5 when he or she can no longer detect a fragrance during use.

A unique feature of the present invention comprises the combination of fragrance-filled capsules 13 and abrasive particles 11. Since the abrasive particles 11 are basically in intimate contact with the fragrance-filled capsules 13, the fragrance-filled capsules 13 are more likely to be ruptured when the scented fingernail file and buffer 5 is used. Since the abrasive particles 11 are generally harder and more abrasive than conventional surfaces, such as fingernails, a fragrance-filled capsule 13 will be more likely to be ruptured when in contact with an abrasive particle 11 than when in contact with the substrate layer 7. Accordingly, since the abrasive particles form a stronger rupturing mechanism, stronger-shelled fragrance-filled capsules 13, requiring a greater rupture forces, may be used with the present invention, and/or fewer fragrance-filled capsules 13 may be used. These features may result in heavy-duty scented fingernail file and buffer configurations.

Another interesting feature associated with the unique combination of abrasive particles 11 and fragrance capsules 13, according to the presently preferred embodiment, is a relationship between the filing force exerted by the scented fingernail file and buffer 5 and the strength of the aroma emitted from the fragrance-filled capsules 13. Generally, the filing force generated by the scented fingernail file and buffer 5 may be increased with the increased pressure on the target surface, and may also be increased with increased filing speed. In the past, users have been required to approximate the filing force that should be applied to the fingernail or toenail, for example. Since differences in filing force will generate different results on the fingernail or toenail, a highly skilled or sensitive user of the present invention may be able to fine-tune the filing process, based upon the strength of the fragrance emitted from the scented fingernail file and buffer 5. For example, a user, who wishes to generate a very smooth surface on his or her fingernail, will be warned that the filing force is too great when a relatively strong fragrance is emitted from the scented fingernail file and buffer 5.

The scent emitted from the fragrance-filled capsules 13 during use of the scented fingernail file and buffer 5 can serve to mask the smell, if any, associated with fingernail or toenail dust. The fragrance also tends to mask the smell of other items in the area such as nail polish or nail polish remover. Additionally, when the scented fingernail file and buffer 5 is used on other objects, any smells associated with the dust generated by the filing thereof, can be masked by the aromas emitted from the fragrance-filled capsules 13.

In addition to emitting fragrances into the atmosphere, the fragrances from the fragrance-filled capsules 13 are also emitted onto the target surface. Many users would regard the application of a desirable scent on their fingernails after filing, for example, to be quite an advantageous feature. The user who is not familiar with scenting his or her fingernails may regard this phenomena in a positive way. Alternatively, users who are already accustomed to scenting their fingernails would more than likely appreciate the saved step of not having to subsequently apply a scent or fragrance to their fingernails after filing.

The treatment substance in the microcapsular 13 may include a fragrance as previously disclosed. Further olfactory purposes can be served by implements providing aroma therapy. In this case, the aroma may be less pleasing than that of a fragrance but, it would nevertheless provide a therapeutic effect to the user.

It will be apparent that other substances can be disposed in the capsules 13 in addition to or other than the fragrances. Of particular interest to a nail processing implement would be those substances which enhance the nail treatment process. For example, the capsules 13 might enclose substances which enhance the health of a fingernail. These might include vitamins, such as A, B, C, D and F vitamins. Conditioning agents such as botanical extracts may also be encapsulated. These might includes, for example, chamomile, tea tree, witch haze, comfrey, calendula and horsetail. The capsules 13 might also enclose natural or synthetic oils which function as moisturizers. Silicone-based blends may also be encapsulated to enhance the appearance of the nails. Of course a fragrance may be included with any or all of these nail treatment substances.

In any case, the microcapsules 13 serve as minute reservoirs for the enclosed substance. When the nail processing implement is used, the frictional relationship with the fingernail tends to rupture or open the microcapsules 13 thereby releasing the enclosed substances. Importantly, this release represents the first time that the encapsulated substance is exposed to the air. As a result, oxidation and degradation, which have plagued prior treatment products, is avoided by the microcapsules 13 which delay release of the substance until the exact moment of use.

Not only is the substance fully active at the moment of released, but there is very little waste as the substance is applied directly to the target surface, such as the nail or surrounding tissue. With the substance at full strength and applied directly to the target surface, less of the substance is required to be provided. Alternatively, the amount of substance provided can be released over a prolonged period of time thereby extending the life of the processing implement.

In a preferred embodiment, the microcapsules 13 are formed of gelatin and are suspended in a polyvinyl alcohol glue base. When the capsules are applied to the implement, this glue base acts as a binder, adhering the capsules the files. By securely adhering the microcapsules 13 to the base structure 9, they tend to remain on the file 5 longer, providing a longer lasting delivery of the encapsulated substances. The polyvinyl alcohol glue base also renders the implement washable.

The individual sizes of the microcapsules 13 can range between 5 microns and 3,000 microns. In a preferred embodiment, the microcapsules 13 have diameters which range between 10 and 50 microns. By varying the diameter of the various microcapsules, they tend to fit more uniformly around the peaks and valleys defined by the larger abrasive granules 11.

The wall thickness of the microcapsules is measured as a percentage of weight. Thus, the percentage of coating material will typically range between 5 percent and 20 percent of the total weight of the microcapsule. The remaining percentage of weight is attributed to the core material or treatment substance and may range between 80 percent and 95 percent.

Within the microcapsular layer, the weight of the capsules will typically be in a range between 15 and 30 percent of the total weight of the layer. The remaining percentage of weight, 70 percent to 85 percent is attributed to either water or mineral spirits. In a preferred embodiment, a water base is desirable, as it leaves no residual other than the microcapsules 13.

In a further embodiment of the invention, the microcapsules 13 are further coated with a plastic material which renders them more durable and therefore long lasting. With a plastic exterior coating, the microcapsules 13 appear more like the abrasive granules. With longer lasting microcapsules, the implements can be made to last considerably longer.

Given these wide variations, which are all within the scope of this concept, one is cautioned not to restrict the invention to the embodiments which have been specifically disclosed and illustrated, but rather encouraged to determine the scope of the invention only with reference to the following claims.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

I claim:

1. A fingernail processing implement, comprising:

a base having a flat elongate configuration and being defined generally by a pair of major surfaces;

a first layer of material disposed over at least one of the major surfaces of the base and having characteristics for performing a predetermined process on the fingernail when the implement is moved in frictional engagement with the fingernail; and a second layer of material disposed relative to the first layer of material, the second layer of material including a multiplicity of microcapsules each releasably enclosing at least one known substance facilitating the processing of the fingernail by the implement.

2. The fingernail processing implement recited in claim 1 wherein the known substance includes at least one of a fragrance, a conditioner, an antibacterial agent, and an appearance enhancer.

3. The fingernail processing apparatus recited in claim 2 wherein the microcapsules include:

a first microcapsule having a wall with a first thickness;

a second microcapsule having a wall with a second thickness greater than the first thickness; whereby the frictional engagement of the fingernail and the implement tends to rupture the first microcapsule prior to the second microcapsule.

4. The fingernail processing apparatus recited in claim 2 wherein the first layer of material includes a multiplicity of abrasive granules.

5. The fingernail processing apparatus recited in claim 4, further comprising:

a foam substrate disposed between the base and the first layer of material.

6. The fingernail processing apparatus recited in claim 2 wherein the first layer of material includes a chamois.

7. The fingernail processing apparatus recited in claim 2 wherein the microcapsules include:

a first microcapsule having a first diameter;

a second microcapsule having a second diameter small than the first diameter;

whereby the fictional engagement of the fingernail and the implement tends to rupture the first microcapsule prior to the second microcapsule.

8. The fingernail processing implement recited in claim 1 wherein the microcapsules have properties for being ruptured in response to the frictional engagement of the fingernail and the implement to release the known substance.

9. The fingernail processing implement recited in claim 3 wherein the microcapsules include at least one microcapsule, comprising:

an outer wall defining an inner cavity; and the known substances being disposed within the inner cavity of the one microcapsule.

10. The fingernail processing implement recited in claim 1 wherein the second layer is disposed in the first layer.

11. The fingernail processing apparatus recited in claim 1 wherein the second layer is disposed on the first layer.

12. The fingernail processing implement recited in claim 1 wherein the known substance includes at least one vitamin.

13. The fingernail processing implement recited in claim 1 wherein the known substance includes at least one botanical oil.

14. The fingernail processing implement recited in claim 1 wherein the known substance includes silicone.

15. The fingernail processing implement recited in claim 1 wherein the known substance includes a moisturizer.

16. The fingernail processing implement recited in claim 1 wherein the known substance is an aroma therapy agent.

17. The fingernail processing implement recited in claim 1 wherein the known substance includes at least one of an antibacterial germicide and an antibacterial fungicide.

18. A fingernail processing implement, comprising:

a base having a flat elongate configuration and being defined generally by at least one major surface;

a layer of foam material having a fixed relationship with the major surface of the base;

an operative layer of the implement having a fixed relationship with the base and sandwiching the foam layer between the base and the operative layer;

a treatment substance impregnated in the foam layer and releasable by the foam layer in response to pressure on the operative layer of the implement.

* * * * *